US005794363A

United States Patent [19]

Marshall et al.

[11] Patent Number: 5,794,363

[45] Date of Patent: Aug. 18, 1998

[54] HANGER HOOK FOR A GARMENT HANGER WITH INDICATOR

[75] Inventors: David John Marshall, Victoria, Australia; Stanley Gouldson, Northport; Roland Harmer, Centereach, both of N.Y.

[73] Assignee: Spotless Plastics Pty. Ltd., Australia

[21] Appl. No.: 384,115

[22] Filed: Feb. 6, 1995

Related U.S. Application Data

[63] Continuation-in-part of Ser. No. 176,087, Dec. 30, 1993, Pat. No. 5,388,354, and Ser. No. 173,905, Dec. 27, 1993, Pat. No. 5,507,086, said Ser. No. 176,087, is a continuation of Ser. No. 985,342, Nov. 30, 1992, abandoned, which is a continuation of Ser. No. 741,462, filed as PCT/AU90/00048 Feb. 8, 1990, abandoned, said Ser. No. 173,905, is a division of Ser. No. 670,963, May 2, 1991, Pat. No. 5,272,806, which is a continuation-in-part of Ser. No. 287,985, Dec. 20, 1988, abandoned.

[51] Int. Cl.[6] ..... G09F 3/00

[52] U.S. Cl. ..... 40/322

[58] Field of Search ..... 40/322, 299; 223/85, 223/DIG. 4

[56] References Cited

U.S. PATENT DOCUMENTS

| | | | |
|---|---|---|---|
| D. 192,845 | 5/1962 | Cohen . | |
| D. 236,572 | 9/1975 | Ostroll et al. . | |
| D. 244,197 | 5/1977 | Ostroll . | |
| D. 264,912 | 6/1982 | Bliss et al. . | |
| D. 282,982 | 3/1986 | Kodet . | |
| D. 302,214 | 7/1989 | Wilson . | |
| 1,634,377 | 7/1927 | Montan et al. . | |
| 2,074,841 | 3/1937 | Haimowitz . | |
| 2,099,596 | 11/1937 | Bruening . | |
| 2,288,071 | 6/1942 | Cohen . | |
| 2,294,527 | 9/1942 | Weiss | 223/85 X |
| 3,024,953 | 3/1962 | O'Keefe . | |
| 3,191,770 | 6/1965 | Zuckerman | 223/85 X |
| 3,341,031 | 9/1967 | Myers . | |
| 3,457,693 | 7/1969 | Jackson . | |
| 3,535,808 | 10/1970 | Morrish . | |
| 3,545,069 | 12/1970 | Krieger . | |
| 3,692,269 | 9/1972 | Hales | 223/85 X |
| 3,734,268 | 5/1973 | Burger et al. . | |
| 3,949,914 | 4/1976 | Ostroll . | |
| 3,955,491 | 5/1976 | McMahon . | |
| 4,006,547 | 2/1977 | Samuels et al. . | |
| 4,006,812 | 2/1977 | Everett et al. . | |
| 4,030,528 | 6/1977 | Horning . | |
| 4,045,899 | 9/1977 | Richardson . | |
| 4,115,940 | 9/1978 | Phillips . | |
| 4,137,661 | 2/1979 | Johansson . | |
| 4,172,513 | 10/1979 | Bradstreet et al. . | |
| 4,322,902 | 4/1982 | Lenthall . | |
| 4,333,590 | 6/1982 | Princiotta . | |

(List continued on next page.)

FOREIGN PATENT DOCUMENTS

| | | |
|---|---|---|
| A 42318/78 | 6/1979 | Australia . |
| B1-42 320 | 6/1979 | Australia . |
| B1-55988/80 | 6/1980 | Australia . |
| A1-57011/80 | 9/1980 | Australia . |
| 5701180 | 10/1980 | Australia . |
| AI 13313/83 | 11/1983 | Australia . |
| A 32008/84 | 2/1985 | Australia . |
| 26077/84 | 8/1986 | Australia . |
| WO 90/09651 | 8/1990 | Australia . |
| 3401816 | 7/1985 | Germany . |
| 518 708 | 8/1972 | Switzerland . |
| 975 548 | 8/1980 | U.S.S.R. . |
| A 2 010 774 | 7/1979 | United Kingdom . |

OTHER PUBLICATIONS

"A&E Products Catalog"; Model 448; p. 10.

*Primary Examiner*—Milton Nelson, Jr.
*Attorney, Agent, or Firm*—Scully, Scott, Murphy & Presser

[57] ABSTRACT

A plastic garment hanger having a hook with an abutment for engaging an aperture formed in an indicator cap to support the indicator cap on the hanger is provided. A hook having an upwardly projecting web which defines an aperture wherein a descending flexible tongue for engaging an aperture formed in an indicator cap is also provided.

10 Claims, 6 Drawing Sheets

U.S. PATENT DOCUMENTS

| | | | |
|---|---|---|---|
| 4,335,987 | 6/1982 | Laxo . | |
| 4,450,639 | 5/1984 | Duester . | |
| 4,714,156 | 12/1987 | Kolton et al. . | |
| 4,718,546 | 1/1988 | Kolton et al. | 40/322 X |
| 4,830,172 | 5/1989 | Hilton et al. . | |
| 4,863,078 | 9/1989 | Bengsch . | |
| 4,886,195 | 12/1989 | Blanchard . | |
| 4,967,500 | 11/1990 | Bredeweg . | |
| 4,997,114 | 3/1991 | Petrou . | |
| 5,065,852 | 11/1991 | Marti . | |
| 5,096,101 | 3/1992 | Norman et al. . | |
| 5,377,884 | 1/1995 | Zuckerman . | |

HANGER HOOK FOR A GARMENT HANGER WITH INDICATOR

CROSS-REFERENCE TO RELATED APPLICATIONS

This is a continuation-in-part of U.S. Ser. No. 08/176,087 filed Dec. 30, 1993, now U.S. Pat. No. 5,388,354, which is a file wrapper continuation of U.S. Ser. No. 07/985,342 filed Nov. 30, 1992, now abandoned, which is a file wrapper continuation of U.S. Ser. No. 07/741,462, filed Nov. 17, 1991, now abandoned, corresponding to International Application No. PCT/AU90/00048 having an international filing date of Feb. 8, 1990.

This is also a continuation-in-part of U.S. Ser. No. 08/173,905 filed Dec. 27, 1993, now U.S. Pat. No. 5,507,086, which is a divisional of U.S. Ser. No. 07/670,963, filed May 2, 1991, now U.S. Pat. No. 5,272,806, which is a continuation-in-part of U.S. Ser. No. 07/287,985 filed Dec. 20, 1988, now abandoned.

FIELD OF THE INVENTION

This invention relates to indicators for garment hangers of the type which may be used to indicate the size of a garment supported by the hanger and/or the name of the manufacturer or retailer. This invention is also directed to the field of garment hangers to which indicators are attached and from which clothing or other articles of apparel are suspended.

BACKGROUND OF THE INVENTION

For purposes of displaying garments suspended on hangers in an orderly and attractive manner to the retail customer, it is often desired to affix an indicating means on the hanger in a position visible to the retail customer while the hanger is suspended on a rack. The indicating means identifies some attribute of the garment suspended from the hanger, such as size, quality, color, manufacturing data, or pattern.

To accommodate the various types of hangers available in the industry numerous indicating means have been developed in a variety of shapes, sizes and materials. Similarly, hangers have been developed to accommodate a variety of different indicating means.

For example, in U.S. Pat. No. 4,137,661 to Johansson a carrier attached to the bottom of a hook of a garment hanger is disclosed. A label may be adhered to or inserted in the carrier portion.

U.S. Pat. No. 3,024,953 to O'Keefe discloses a rectangular plastic guard which is adapted to be secured to the wire hook of a clothes hanger, and which extends upwardly therefrom to assist in preventing the clothes hangers from becoming entangled with one another.

U.S. Pat. No. 1,099,261 to Lewyt discloses a clothes hanger particularly adapted for hanging sets of furs, with a metal rectangular plate 10 which receives an index card describing the furs suspended therefrom and is positioned substantially between the hook and body portion of the hanger.

U.S. Pat. No. 4,115,940 to Phillips discloses an indicia-bearing tab which attaches to a member located substantially at the junction of both the hook and the body member.

U.S. Pat. No. Des. 302,214 to Wilson includes two embodiments directed to ornamental designs for garment hangers which include a designated member for attaching an indicating means.

U.S. Pat. No. Des. 244,197 to Ostroll discloses an ornamental design for a size indicator that is intended for attachment to a garment hanger.

The provision of a readily visible size indicator on a garment hanger is now accepted by retailers as a desirable addition to a garment hanger. The most widely accepted indicators have been manufactured by the applicant under Australian Patent No. 509042 (AU-B-42320/78 which corresponds to U.S. Pat. No. 4,322,902 to Lenthall) and Australian Patent No. 522614 (AU-B-55988/80). While the indicator disclosed in Australian Patent No. 509042 in particular has been well received by retailers in Australia, the desire of some retailers to reduce to a minimum the costs of hangers and indicators has meant that other manufacturers have developed less aesthetically pleasing alternatives to the indicator of the Australian Patent. In addition, differences in attitude have indicated that the "cap" indicator of Australian Patent No. 509042 may be regarded by some as being too bulky and dominant in the overall view of the hanger and the garments supported thereon.

The automated manufacture of hangers with indicators is described in U.S. Pat. No. 5,272,806 assigned to the assignee of this invention, and the specification thereof is hereby incorporated herein by reference thereto. U.S. Pat. No. 5,272,806 describes a low-profile molded plastics indicator for garment hangers which requires modification to the hook of the hanger to enable the indicator to be securely attached to the top of the hook where it is most visible. The improvements described in the above patent overcame the major disadvantages of indicators of the type described in our U.S. Pat. No. 4,322,902. The indicator according to U.S. Pat. No. 5,272,806 is also designed to enable sorting into a predetermined orientation to enable automated handling and fitting of the indicators. For these reasons, the indicator has enjoyed considerable commercial success.

Other indicators for hangers and hanger hooks for receiving indicators on disclosed are disclosed in U.S. Pat. No. 4,045,899 and German Offenlegangsschrift DE 3901086.

SUMMARY OF THE INVENTION

It is therefore an object of the present invention to provide an improved hanger hook for receiving the indicator described in U.S. Pat. No. 5,272,806.

The invention therefore provides an improved hook design for receiving an indicator suitable for attachment to the hook of a molded plastic garment hanger, wherein the indicator comprises a body adapted to display indicia, and comprising side walls, end walls and a top wall dimensioned to form a body having a low generally rectangular profile and defining a downwardly opening cavity shaped and dimensioned to receive a narrow upwardly projecting web formed on a hook of a molded plastic garment hanger, said body having regions between at least said side walls and said top wall which are smoothly rounded while the lowermost edges of at least said side walls are substantially non-rounded to define relatively sharp edges at said lowermost edges, said end walls being spaced to engage in use spaced points on said web such that said indicator is in use stably supported on said web, said smoothly rounded portions and said sharp edges facilitating sorting of said indicators into a preferred orientation.

In a preferred form, the cavity is formed with a centrally positioned means dimensioned and positioned to receive an abutment means formed on the upwardly projecting web of the hook of the hanger. In one form, at least one side of the body of the indicator defining the cavity is formed with an opening adapted to receive said abutment. In a particularly preferred form, each side of the body has an opening adapted to receive an abutment formed on either side of the web of the hanger hook.

The invention also provides in combination, an indicator suitable for attachment to the hook of a molded plastic garment hanger, said indicator comprising a body adapted to display indicia and comprising side walls, end walls and a top wall dimensioned to form a body having a low generally rectangular profile and defining a downwardly opening cavity shaped and dimensioned to receive a narrow upwardly projecting web formed on a hook of a molded plastic garment hanger, said body having regions between at least said side walls and said top wall which are smoothly rounded while the lowermost edges of at least said side walls are substantially non-rounded to define relatively sharp edges at said lowermost edges, said end walls being spaced to engage in use spaced points on said web such that said indicator is in use stably supported on said web, said smoothly rounded portions and said sharp edges facilitating sorting of said indicators into a preferred orientation.

Another object of the present invention is to provide a garment hanger having a means capable of receiving and engaging a corresponding engagement point on an indicator. More particularly, the present invention also includes a garment hanger having an indexing cap for identifying at least one characteristic of the garment hanging therefrom wherein the garment hanger includes a hook adapted to engage a rod or other supporting means, and an upstanding flange extending from the hook for receiving one indexing cap, said flange extending and projecting above the top contour of the hook. The hanger of the present invention also includes a snap-fit engagement means defined by the upstanding flange, and a generally planar and stackable indexing cap having a recess formed therein for receiving the flange of the hanger therewithin. The indexing cap also defines a through opening which facilitates stacking the indexing cap in a bundle of stacked caps during transport, and which receives the snap fit engagement means when the indexing cap is attached to the hanger.

In still another embodiment the upstanding flange is shaped and dimensioned to correspond substantially to the recess formed in the indexing cap. The upstanding flange defines a window opening and further includes a descending tongue capable of engaging an aperture formed in an indicator cap. The engagement means and upstanding flange of this embodiment are particularly adapted to prevent unintentional removal of the indicator cap from the hanger yet facilitate intentional removal of the indicator cap from hanger when the hanger is recycled or used with a garment of a different size.

The hanger hook of the present invention is adapted to engage a rail or other supporting means to suspend the hanger and garment therefrom. The hook has an upstanding web which extends upwardly from the hook above the top contour of the hook which engages the rail or other supporting means.

The web includes means to position and releasably secure the indicator to the hook to prevent the inadvertent release of the indicator in normal use. The releasable securing means permits the removal of the indicator for recycling of the hanger body and reuse with a new and appropriately coded indicator.

The invention also provides the combination of a hanger having a hook with a narrow upwardly projecting web and an indicator as defined above engaging said web.

It is an object of the present invention to provide an improved indicator attachment mechanism which securely fastens an indicator to a hanger but which allows removal of the indicator in a simple operation which reduces the likelihood of damage to the indicator or to the hanger.

The invention therefore also provides a molded plastics hanger hook having an improved indicator attachment device, said hanger having a hook formed with an upstanding web shaped to be received within a downwardly opening cavity of a molded plastics indicator, said indicator having side walls formed with at least one opening adapted to receive attachment means for retaining the indicator on said web of said hook, said attachment means comprising a resilient detent means formed in said upstanding web and having a laterally projecting portion positioned to engage said side wall opening to prevent removal of said indicator from said hook, said resilient detent means enabling said laterally projecting portion to be disengaged from said opening to facilitate removal of said indicator from said hook without damage to said indicator or to said hook.

In use, the laterally projecting portion is disengaged from the side wall opening by inserting a probe through the side wall opening to displace the projecting portion from the opening to thereby release the indicator from the hook.

The detent means preferably comprises a downwardly depending leg integrally molded within a molded opening in said web and resiliently connected to said web to enable deflection of said laterally projecting portion into the plane of the web to facilitate removal of the indicator from the web.

In order that the invention may be more readily understood, embodiments of the invention will now be described with reference to the accompanying drawings.

BRIEF DESCRIPTION OF THE DRAWINGS

The foregoing and other objects of the invention may now be more readily ascertained from the following detailed description of preferred embodiments thereof, taken in conjunction with the accompanying drawings; in which.

DESCRIPTION OF THE PREFERRED EMBODIMENTS

Figure 3:
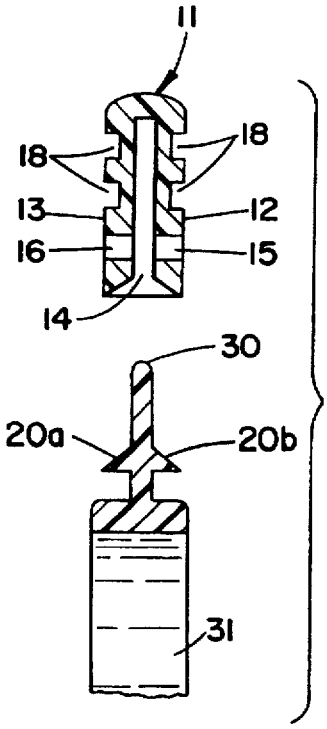
FIG. 3 is a sectional end elevation view of the indicator taken along line 3—3 in FIG. 2 and a first embodiment of the hook as illustrated in FIG. 2 but with the hook removed from the indicator.
Figure 1:
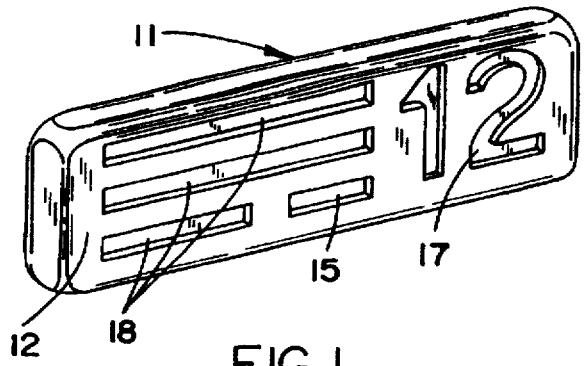
FIG. 1 is a perspective view of an indicator embodying the invention.
Figure 4:
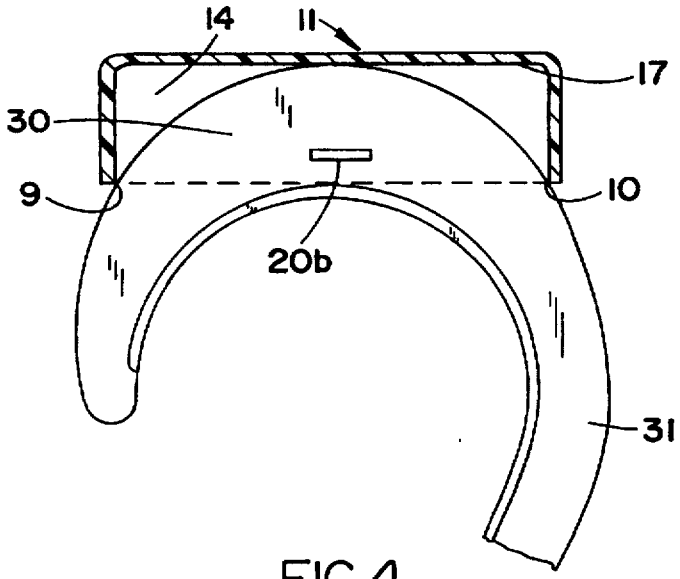
FIG. 4 is an enlarged transverse sectional view FIG. 2 taken along line 4–4'.

Referring to the drawings, and particularly FIGS. 1–4, the indicator embodying the invention will be seen to comprise a body 11 molded from suitable plastic material having spaced flat sides 12 and 13 defining therebetween a cavity 14 dimensioned to receive a top web 30 of the hook 31 of a garment hanger, as shown in FIGS. 3 and 4 of the drawings. The sides 12 and 13 are formed with generally rectangular slots 15 and 16 centrally located adjacent the lower edges of the sides 12 and 13, and which are dimensioned and positioned to receive abutments 20*a*, 20*b* formed on either side of the web 30 of the hook 31 of the hanger to lock the indicator in position on the hook 31. The entry of abutments 20*a*, 20*b* into slots 15 and 16 is achieved by the resilience of the plastic molding forming the body 1.

Each side 12 and 13 of the indicator 11 is formed with indicia 17, in the present embodiment, a sizing number such as 12. In the present case, the indicia 17 is formed by molded depressions in the sides 12 and 13, although the indicia may equally well be formed by molded raised portions or by adhesive label applied to the sides 12 and 13. If desired, styling grooves such as 18 may also be formed in or on the surface of the sides 12 and 13.

Figure 2:
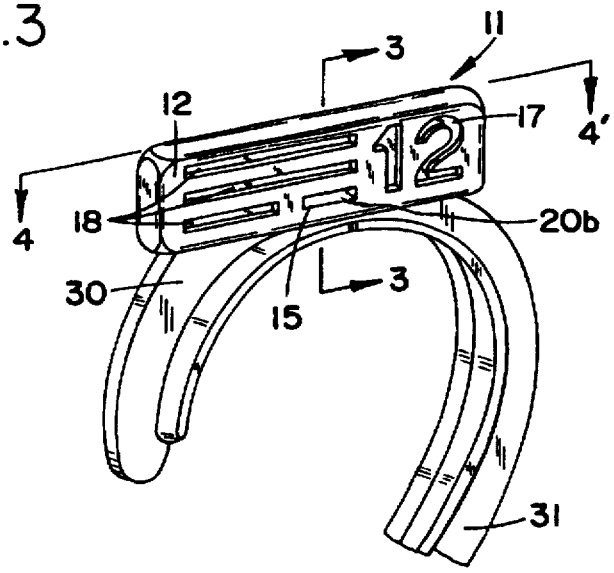
FIG. 2 is a perspective view of the indicator of FIG. 1 fitted to the hook of a hanger.

It will be appreciated from FIGS. 2 and 4 of the drawings that the width of the indicator body 11 is approximately the same as the width of the hook 31 of the hanger, and the indicator has a relatively low narrow rectangular profile. Of course, shapes other than rectangular may be adopted, but it is considered desirable that the width of the indicator should not materially exceed the width of the hook of the hanger so that the indicator is not obtrusive in use.

The indicator body is also formed with smoothly rounded edges, particularly at the upper most edges of the body, as shown in FIGS. 2 and 3. This feature allows the indicators to be sorted with the cavity directed downwardly by running the indicators along a narrow edge in the sorting machine (not shown) whereby the engagement between the rounded edges and the narrow edge cause an indicator engaging the edge in this manner to topple over so that its cavity is directed downwardly.

The web 30 formed on the hook of the hanger 31 is shaped to provide engagement points between the ends 9 and 10 of the opening to the cavity 14 and the top 19 of the cavity 4 when the indicator is fitted to the web 30 to limit movement of the indicator on the hook 31. By the same token, the shape of the web 30 is not significantly different from a "normal" shape of hook 31 so the hanger can be used with or without the indicator.

While the web shape shown in FIG. 4 is preferred, for stability, a more standard web shape will provide acceptable results since the ends 9 and 10 of the opening to the cavity 14 of the indicator will still wedgingly engage the spaced edge portions of the web 30 to limit the amount of movement of the indicator even though the top of the web 30 does not contact the top 19 of the cavity 14.

Of course, the web may be molded with an upwardly projecting generally rectangular portion (not shown) which substantially fills the cavity 14 to inhibit any significant movement of the indicator on the web 30 of the hook 31. Such an arrangement has the advantage of providing a rectangular surface on the hook for labels when the indicator is not used.

Alternatively, the cavity 4 may be shaped to correspond to the exact shape of the web 30, although the net benefit of such an arrangement would not appear to outweigh the extra amount of plastic required for such a molding.

It will be appreciated from the above description that an indicator installed on a hook embodying the invention provides an aesthetically acceptable indicator with only a minimal modification being required to the shape of the hook of the hanger to which the indicator is to be applied. The indicator presents a narrow profile which does not excessively modify the shape of the uppermost end of the hook of the hanger, while the hook itself may be used without the indicator since it is not significantly different in shape to other hooks.

FIGS. 5–10 illustrate a second embodiment of the garment hanger and the indicator of the present invention. While the invention will be described and illustrated with respect to the hook of a single bra and panty hanger, it is understood that the invention is equally applicable to other types of garment hangers.

Figure 5:
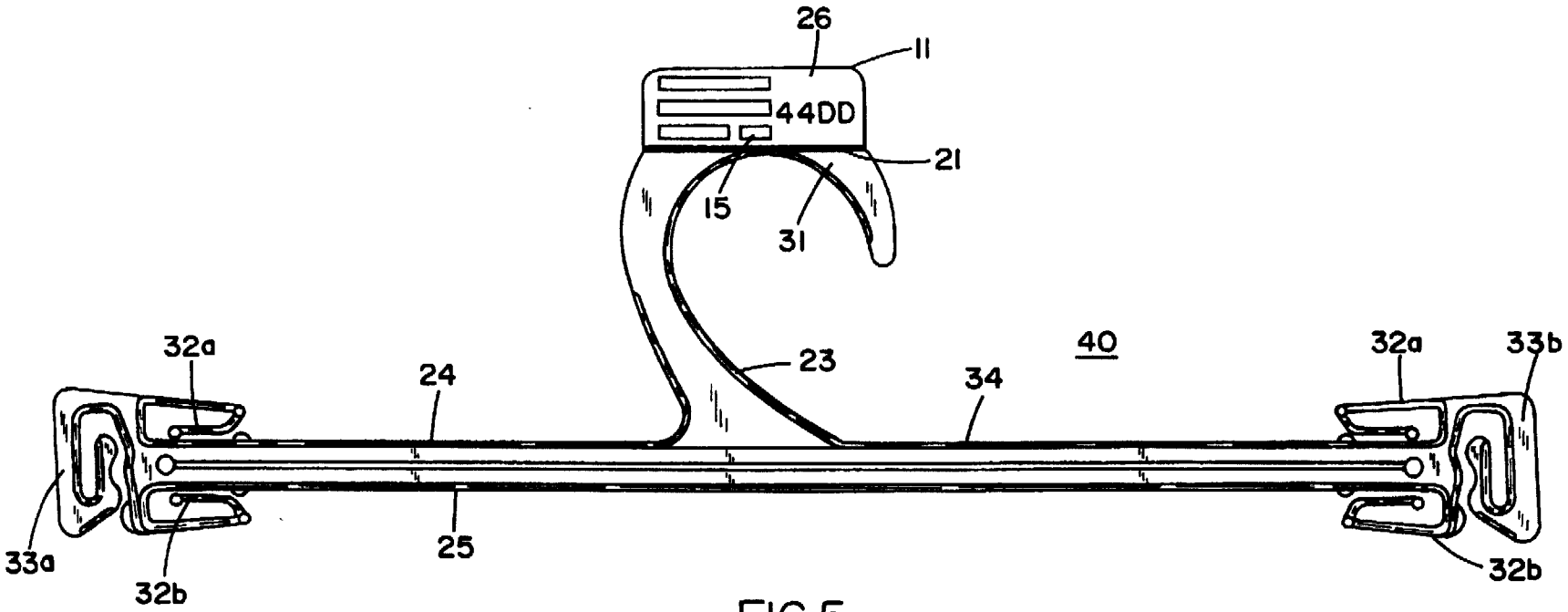
FIG. 5 is a plan view of one side of a bra and panty garment hanger having an index coded cap relating to an attribute of a bra to be suspended therefrom.
Figures 6, 7, 8, 9, 10:
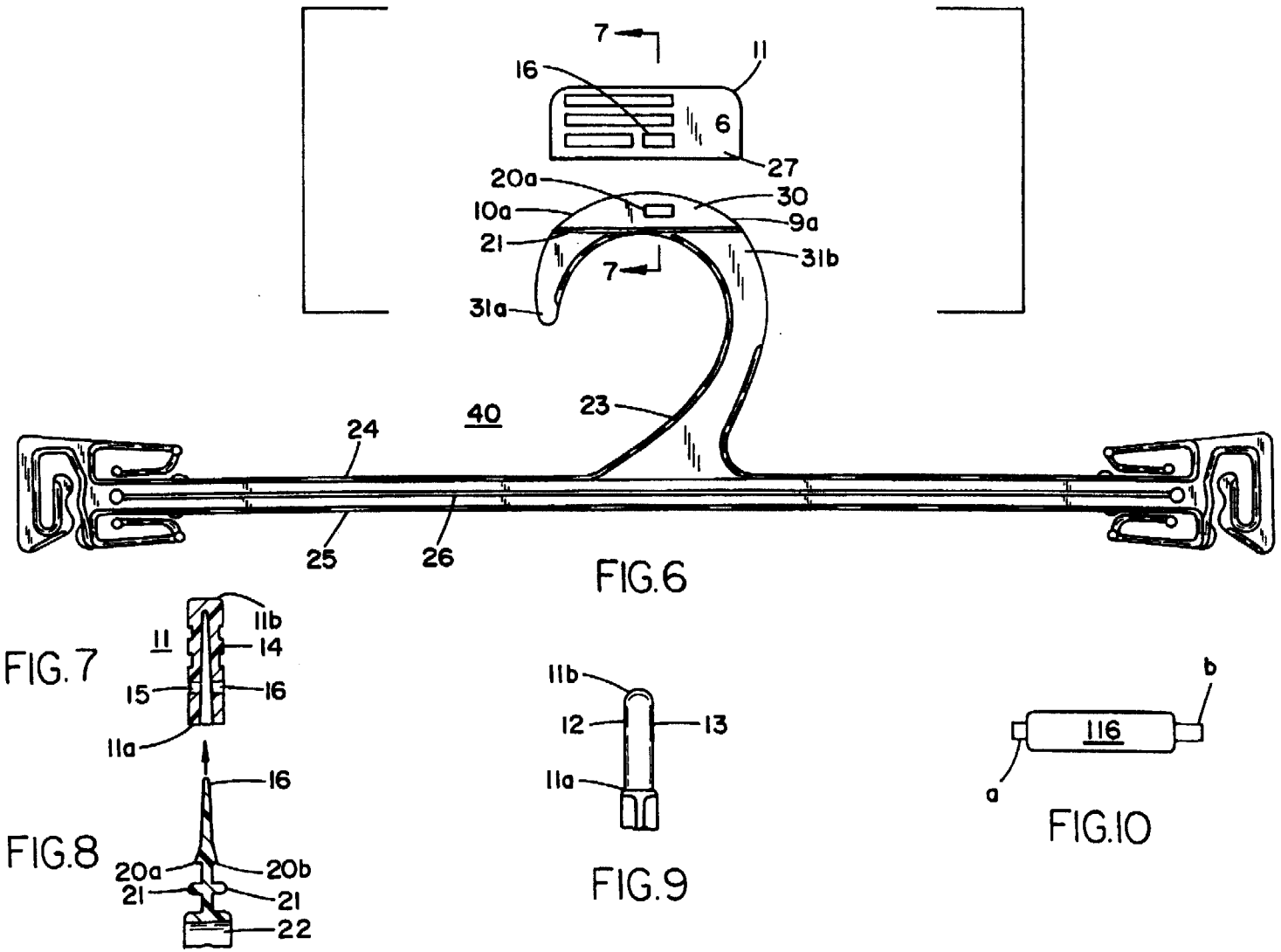
FIG. 6 is an exploded view of the opposite side of the bra and panty hanger illustrated in FIG. 5 with the index coded cap separated from the hanger and displaying an attribute of a panty to be suspended therefrom.
FIG. 7 illustrates a cross-section of the index coded cap taken along line 7—7 of FIG. 6.
FIG. 8 represents a corresponding cross-section of a second embodiment of the hanger taken along section line 7—7 of FIG. 6.
FIG. 9 illustrates an end view of the indexing cap seated on the hanger hook as illustrated in FIG. 5.
FIG. 10 illustrates a top view of the indexing cap and hook illustrated in FIG. 5.

As illustrated in FIGS. 5 and 6, the garment hanger is a bra and panty hanger 40 having bra hanger strap clips 32*a*, 32*b* and panty hanger clips 33*a*, 33*b* arranged at either end of central support 34. The hanger presents a first side in FIG. 5 and the opposite side in FIG. 6 with the indicator 11 positioned for attachment in FIG. 6.

Hanger 40 also includes a hook member 31 having an upstanding flange 30 (illustrated in FIG. 6) for receiving one of a plurality of different indicators, one of which is illustrated at 11 in FIGS. 5–10. The flange 30 projects above the top contour of hook 31. A snap fit engagement means abutment 20 is defined on either side of the upstanding flange 30 as illustrated in FIGS. 6 and 8. The index coded indicator 11 is generally planar and stackable and has a recess 14 formed therein (illustrated in FIG. 7) for receiving the upstanding flange 30 therewithin. The indicator 11 defines a pair of apertures 15, 16 which define through opening 22 (illustrated in FIGS. 5–7) which receives the snap fit engagement means 20 when the indicator is fitted to the upstanding flange. This through opening may also be used to form a bundle of indicators or "stacked caps". The hook member further defines a horizontal flange 21 which cooperates with the snap fit engagement means 20*a*, 20*b* to engage the indicator in a wedging manner. The snap fit abutments 20*a*, 20*b* may also cooperate with the arcuate edges 9*a*, 10*a* of flange 30 to wedgingly engage the indicator 11 as previously described with respect to FIG. 9. Edges 9*a* and 10*b* extend upwardly and inwardly in an angular fashion (as illustrated in FIG. 8) to assist in centering the cap for engagement of the snap fit engagement means 15, 16 and 20*a*, 20*b*. Hook member 31 also includes an inner flange 23 which extends from the tip 31*a* of the hook to the intermediate frame member 34 to strengthen the hook and to provide a larger load bearing surface when the hanger engages a rod or other supporting means during use. Hook member 31 also includes a second reinforcing rib 24 which extends upwardly from control support member 34 to strengthen the hook and to resist twisting or flexure of the hook 31 when the garment hanger is in use. Central support member 34 includes upper and lower flanges 24, 25 and a center medial flange 26 which serve to stiffen the hanger.

By choosing a relatively resilient plastic material for the hanger 40, and a relatively stiff plastic material for the indicator 11, the snap fit engagement can be made relatively permanent, since once the indicator is secured by snap fit engagement barbs 20*a*, 20*b*, it is necessary to bend or flex the side walls 12, 13 beyond barbs 20*a*, 20*b* before the indicator can be removed. The stiffness of the plastic material used to form the indicator thereby determines the degree of difficulty one encounters in removing it. Further, the fit and cooperation of the flat edge 11*a* of the indicator and the horizontal flange 21 make it difficult to insert a screw driver, or other means, with which to pry the side walls apart for removal of the indicator.

As illustrated in FIGS. 5–10, the indicator includes several indexing features. The cap is color coded to denote a specific attribute of the garment suspended from the hanger. In addition, the indicator 11 carries on one side the legend 44 DD as illustrated on flat surface 26 to denote a bra size suspended from the hanger. On the opposite side of the cap, as illustrated at flat surface 27 in FIG. 6, a panty size "6" is indicated for a hypothetical bra and panty set. In this instance, the color coding can relate to a certain grade and quality of garment, a certain style of garment, or to visually reinforce one of the printed indicia such as cup size or panty size. This color attribute assists the purchaser in selecting the appropriate garment for his or her intended use.

The indicator 11 is planar, having first and second planar sides 12, 13 which facilitate stacking of the indicators for shipment as a bundle of "stacked caps". The bottom portion of the indicator 11*a* defines a flat edge, while the top edge 11*b* of the indicator may be rounded. The flat configuration 11*a* and rounded configuration 11*b* assist the sorting and stacking mechanism in a machine (not shown) which automatically aligns and stacks the indicators in a predetermined manner, as more fully described in U.S. Pat. No. 5,272,806, assigned the assignee of this application, the disclosure of which is hereby incorporated herewith by reference thereto.

As illustrated in FIG. 10, the top of the indicator 11*b* is unadorned in the preferred embodiment and as illustrated in FIG. 10, may be somewhat wider than the internal flange 23. It should be noted that as illustrated in FIG. 10, flanges 30 is not visible, and that horizontal flange 21 is substantially the same length as the indexing cap 11, and therefore not visible in FIG. 10.

The garment hanger illustrated in FIGS. 5 and 6 also includes a center strengthening rib 26. The use of ribs 24–26 allow the central web of the hanger to be reduced in thickness and weight, thereby reducing the material cost for the hanger and the shipping cost during transit from the various remote manufacturing facilities to the United States.

A third embodiment of the hanger of the present invention is depicted in FIGS. 11–16, which includes a hook 31, adapted to engage a rod or other supporting means, with an upwardly projecting web 31 extending upwardly above the top contour 31*a* of hook 31 that engages a rod or other supporting device. An aperture 35 is defined in said upwardly projecting web such that upwardly projecting web 30 completely surrounds aperture 35. Tongue 36 descends from an upper portion 38 of the upwardly projecting web into the aperture 35.

Figure 11:
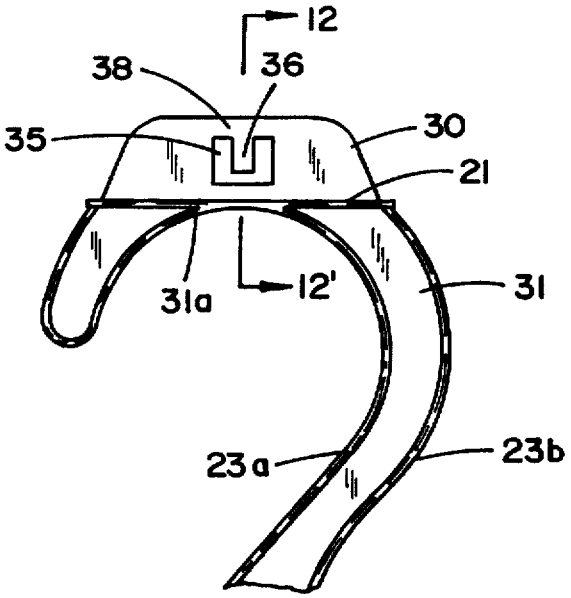
FIG. 11 a front elevation view of the hook of a hanger incorporating a third embodiment of the improved indicator attachment mechanism of the invention.
Figure 12:
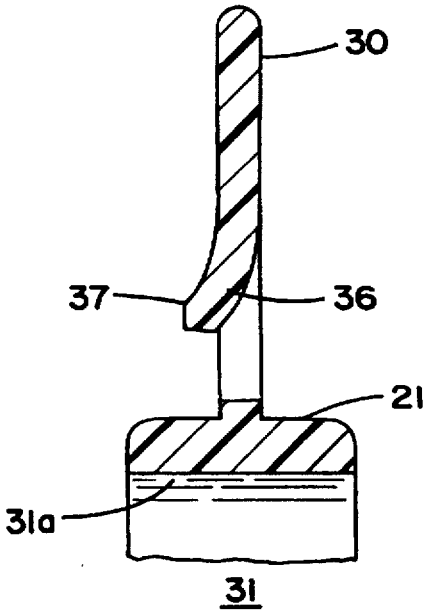
FIG. 12 illustrates an enlarged view of a cross section taken along line 12—12 in FIG. 11.
Figure 13:
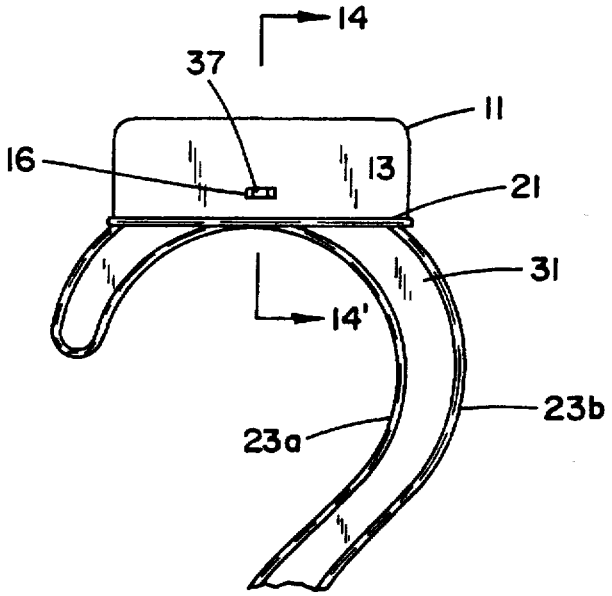
FIG. 13 illustrates a front elevation view of the hanger hook depicted in FIG. 11 with an indicator cap seated thereon.

Referring to FIGS. 11 and 12 of the drawings, a modified embodiment of the hook 31 of a molded plastics garment hanger is shown in simplified form and will in practice normally include the usual strengthening ribs 23*a*, 23*b* around the perimeter of the hook. The hook 31 is formed with a flattened top region on rib 21 slightly larger in peripheral dimensions than the lowermost portion of an indicator 11 having side walls 12, 13 formed with retention openings 15, 16, as described in our Australian Pat. No. 638436 and corresponding U.S. Pat. No. 5,388,354, the contents of which are incorporated into this specification by cross-reference thereto. An upstanding narrow web 30 extends centrally from the flattened top region 21 of the hook 11, and in this embodiment the web is shaped similarly to the shape of the cavity of the indicator 11 so as to comfortably fit within that cavity. Alternatively, the web 30 may be configured in the manner shown in Australian Patent No. 638436.

Figure 14:
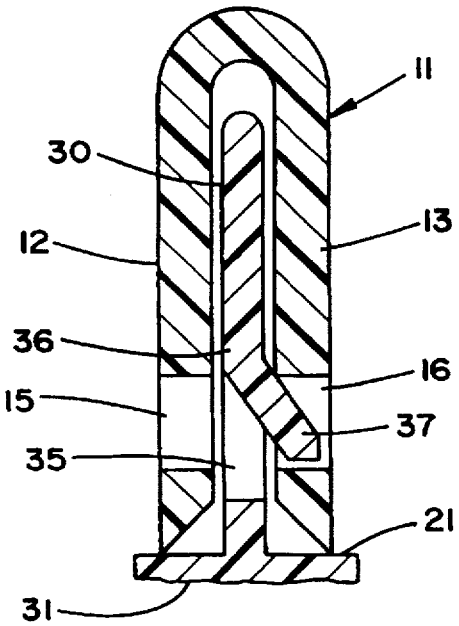
FIG. 14 is an enlarged view of a section taken along the line 14–14' in FIG. 13.

The web 30 is formed with integrally molded indicator attachment means 36. In the present embodiment, the attachment means includes central opening 3 defined in the upper portion of flange 30 with a resilient detent tongue 36 which extends downwardly terminating in a laterally extending portion 37 configured to engage one of the openings 15, 16 in the side walls 12, 13 of the indicator 11, as shown in FIG. 14 of the drawings. Since the detent leg 37 is narrow and is resiliently connected to the web 31, it is easily able to be laterally deflected by means of a probe inserted in the opening 16 and engaging the portion 37 to displace the portion 37 towards the plane of the web 31 to clear the opening 16 and allow the indicator 11 to be removed from the web 31. This operation can be achieved simply and quickly with little or no damage to the indicator 11 or to the attachment means 36. Nevertheless, while the laterally extending portion 37 remains in the position shown in FIG. 14 of the drawings, the indicator 11 will remain securely fastened to the web 31 and will withstand all usual handling operations to which the hanger is usually subjected in day-to-day use.

Figure 15:
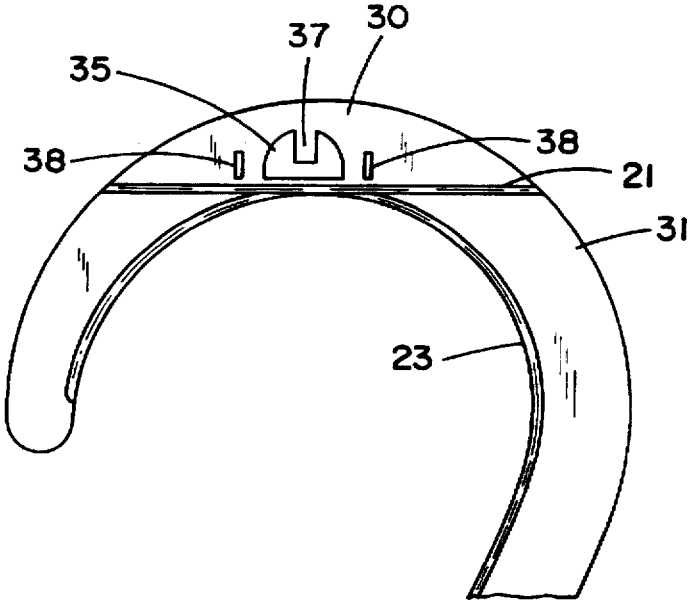
FIG. 15 illustrates a front elevation view of a fourth embodiment of the hanger hook of the present invention.
Figure 16:
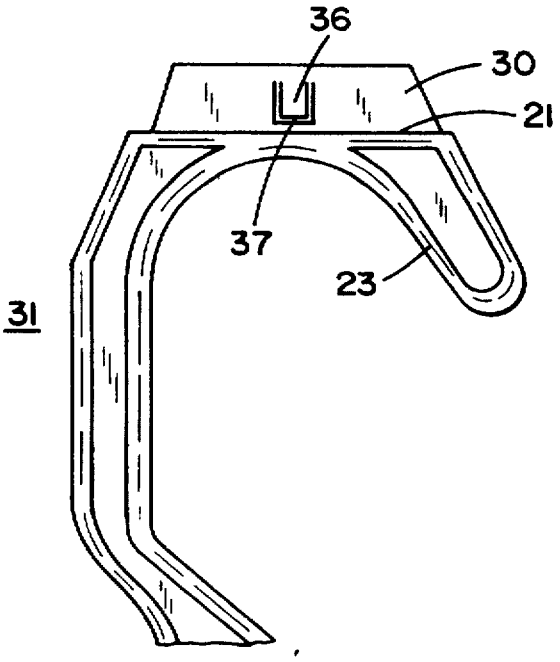
FIG. 16 illustrates a front elevation view of a fifth embodiment of the hanger hook of the present invention.

Referring now to FIGS. 15 to 16 of the drawings, a modified embodiment of the invention is shown in which the same reference numerals are used to indicate similar parts. In this embodiment, the resilient detent leg 36 also extends angularly from its point of attachment to the web 30, as shown most clearly in FIGS. 15 and 16 of the drawings, and has a shorter laterally extending portion 37 formed at its free end. The upstanding web 30 of the hook 31 is further formed with a pair of ribs 38 on either side of the central semicircular opening 35 to prevent the indicator 11 (not shown in FIG. 15) being inadvertently laterally displaced to clear the laterally extending portion 37 which engages the opening 16 in a manner similar to that shown in FIG. 14 of the drawings. FIG. 16 illustrates the hook 31 of the present invention in which rib 21 is integrally formed as part of the strengthening flange 23, which as illustrated in FIG. 16, extends around the perimeter of hook 31. The indicator 11 for the hook illustrated in FIG. 16 may also be formed with angled or sloping end walls to conform to the angularity of the hook design.

The indicator attachment mechanisms described in the above embodiments provide a particularly simple and convenient means of retaining the indicator 11 on the web 30 of the hook 31 while enabling the indicator 11 to be conveniently removed in a simple operation which does not significantly damage either the indicator 11 or the hook 31 of the hanger. In this way, the disadvantages associated with the attachment mechanism described in our Australian Patent No. 638436 are overcome in a simple but innovative manner.

In the preferred embodiment, the improved hanger hook of the present invention is formed of styrene which provides a clear, virtually transparent hanger for maximum display of garments suspended therefrom. Alternately, the hanger could be formed from K resin, H.I. styrene and polypropylene or other suitable thermoplastics.

While there have been shown and described what are considered to be the several preferred embodiments of the invention, it will, of course, be understood that various modifications and changes in form or detail can readily be made without departing from the spirit of the invention. It is therefore intended that the invention not be limited to the exact form and detail herein shown and described nor to anything less than the whole of the invention herein disclosed as hereinafter claimed.

What is claimed is:

1. A plastic garment hanger comprising:

a hook adapted to engage a supporting means, said hook having an upwardly projecting web extending from said hook; and an indicator attachment means formed on said upwardly projecting web to engage and releasably secure said indicator to said upwardly projecting web, wherein said attachment means comprises a resilient detent means formed in said upwardly projecting web, said resilient detent means terminating in a resiliently mounted laterally projecting portion.

2. The garment hanger of claim 1, wherein said laterally projecting portion is flexible.

3. The garment hanger of claim 1, which includes an aperture, wherein said aperture is defined by a top edge, bottom edge and side edges of said upwardly projecting web and said laterally projecting portion descends from said top edge.

4. The garment hanger of claim 1, wherein said laterally projecting portion is formed to extend outwardly beyond a plane defined by said web.

5. The garment hanger of claim 1, wherein said hook, said web and said garment hanger are integrally molded.

6. The garment hanger of claim 1 wherein said upwardly projecting web is shaped and dimensioned to extend upwardly from the hook above the top contour of the hook which engages a supporting means.

7. The garment hanger of claim 1, wherein said upwardly projecting web defines an aperture.

8. The garment hanger of claim 7, wherein said aperture is of a substantially square configuration.

9. The garment hanger of claim 7, wherein said aperture is of a substantially semi-circular configuration.

10. The garment hanger of claim 7, wherein said aperture is of a substantially rectangular configuration.

* * * * *